US011598347B2

(12) United States Patent
Gronvall

(10) Patent No.: US 11,598,347 B2
(45) Date of Patent: Mar. 7, 2023

(54) IMPELLER WITH EXTERNAL BLADES

(71) Applicant: TRANE INTERNATIONAL INC., Davidson, NC (US)

(72) Inventor: Joel Gronvall, La Crosse, WI (US)

(73) Assignee: TRANE INTERNATIONAL INC., Davidson, NC (US)

( * ) Notice: Subject to any disclaimer, the term of this patent is extended or adjusted under 35 U.S.C. 154(b) by 284 days.

(21) Appl. No.: 16/457,310

(22) Filed: Jun. 28, 2019

(65) Prior Publication Data

US 2020/0408220 A1 Dec. 31, 2020

(51) Int. Cl.

| | |
|---|---|
| ***F04D 29/22*** | (2006.01) |
| ***F04D 1/02*** | (2006.01) |
| ***F25B 1/053*** | (2006.01) |

(52) U.S. Cl.

CPC ..... *F04D 29/2266* (2013.01); *F04D 1/025* (2013.01); *F25B 1/053* (2013.01)

(58) Field of Classification Search

CPC ..... F25B 31/026; F25B 1/04; F04D 29/285; F04D 29/284; F04D 29/2266; F04D 29/34; F04D 29/324; F04D 29/44; F04D 29/444; F04D 1/025

See application file for complete search history.

(56) References Cited

U.S. PATENT DOCUMENTS 2,970,750 A * 2/1961 Swearingen ..... F04D 17/164 415/181
3,224,078 A * 12/1965 Mayne ..... B21D 53/267 29/889.4
3,541,607 A * 11/1970 Raymond ..... F04D 29/2266 415/112
4,978,278 A 12/1990 Kun
5,295,785 A * 3/1994 Church ..... F04D 29/4213 415/119
6,280,143 B1 * 8/2001 Parker ..... F04D 29/284 416/186 R
6,386,839 B1 * 5/2002 Chuang ..... F01D 5/045 415/199.6
6,592,329 B1 7/2003 Hirose et al.
(Continued)

FOREIGN PATENT DOCUMENTS

| | | |
|---|---|---|
| CN | 105840523 A | 8/2016 |
| DE | 10256805 A1 | 6/2004 |
| JP | 6374744 B2 * | 8/2018 |

OTHER PUBLICATIONS

JP6374744B2 English Machine Translation (Year: 2018).*
(Continued)

*Primary Examiner* — Jenna M Hopkins
(74) *Attorney, Agent, or Firm* — Hamre, Schumann, Mueller & Larson, P.C.

(57) ABSTRACT

A compressor includes a housing, a shaft, and an impeller rotatable relative to the housing by the shaft. The impeller includes a hub, impeller blades, and external blades. The impeller blades extend from a front of the hub. The external blades protrude from a rear surface of the hub or an outer surface of a shroud of the impeller. The external blades are curved along the rear surface or the outer surface. A heat transfer circuit includes a compressor and a working fluid. The compressor includes an impeller having a hub, impeller blades, and external blades.

18 Claims, 8 Drawing Sheets

(56) References Cited

U.S. PATENT DOCUMENTS

| | | | | |
|---|---|---|---|---|
| 6,834,501 | B1 * | 12/2004 | Vrbas | F02C 6/12 60/612 |
| 6,997,686 | B2 * | 2/2006 | Agrawal | F04D 17/12 417/250 |
| 7,189,059 | B2 * | 3/2007 | Barton | F01D 5/26 415/186 |
| 7,338,251 | B2 * | 3/2008 | Ro | F04D 29/4206 415/58.3 |
| 7,628,586 | B2 * | 12/2009 | Feher | B23P 15/006 415/170.1 |
| 8,128,865 | B2 * | 3/2012 | Jahnz | B22F 3/15 419/5 |
| 8,998,581 | B2 * | 4/2015 | Giovannetti | F04D 29/284 416/180 |
| 9,394,913 | B2 * | 7/2016 | Taguchi | F04D 29/682 |
| 9,689,402 | B2 * | 6/2017 | Elebiary | F04D 29/2266 |
| 9,933,185 | B2 * | 4/2018 | Kameyama | F04D 29/023 |
| 10,393,143 | B2 * | 8/2019 | Kuno | F04D 29/444 |
| 10,436,211 | B2 * | 10/2019 | McArdle | F04D 29/685 |
| 10,619,645 | B2 * | 4/2020 | Daussin | F04D 29/102 |
| 10,710,186 | B2 * | 7/2020 | Yamada | F01D 5/04 |
| 10,830,249 | B2 * | 11/2020 | Pulnikov | F04D 29/284 |
| 11,041,503 | B2 * | 6/2021 | Iurisci | F04D 29/284 |
| 11,073,162 | B2 * | 7/2021 | Hermes | F04D 29/44 |
| 2006/0280609 | A1 * | 12/2006 | Ranz | B23P 15/006 416/182 |
| 2014/0286761 | A1 * | 9/2014 | Kim | F04D 29/162 415/173.1 |
| 2018/0142694 | A1 * | 5/2018 | Daussin | F04D 29/056 |
| 2018/0328379 | A1 * | 11/2018 | Harris | F04D 29/4213 |
| 2019/0374732 | A1 * | 12/2019 | Cariola | F04D 29/30 |
| 2020/0378389 | A1 * | 12/2020 | Shibata | F02B 39/10 |
| 2020/0408220 | A1 * | 12/2020 | Gronvall | F04D 1/025 |
| 2020/0408245 | A1 * | 12/2020 | Jeung | F16C 17/024 |
| 2021/0095677 | A1 * | 4/2021 | Dittmar | F04D 23/008 |

OTHER PUBLICATIONS

Extended European Search Report, European Patent Application No. 20181884.6, dated Oct. 22, 2020 (6 pages).

Examination report; European Patent Application No. 20181884.6, dated Dec. 14, 2021 (4 pages).

* cited by examiner

IMPELLER WITH EXTERNAL BLADES

FIELD

This disclosure relates to impellers used in compressors. More specifically, this disclosure relates to impellers in compressors utilized in heating, ventilation, air conditioning, and refrigeration ("HVACR") systems

BACKGROUND

A compressor can include a housing and an impeller with impeller blades. The compressor rotates the impeller relative to the housing. Working fluid is suctioned into the rotating impeller blades and is discharged from the impeller as compressed working fluid. An impeller can include a shroud for the impeller blades. The impeller is spaced apart from the housing of the compressor to allow rotation of the impeller relative to the housing. HVACR systems are generally used to heat, cool, and/or ventilate an enclosed space (e.g., an interior space of a commercial building or a residential building, an interior space of a refrigerated transport unit, or the like). A HVACR system can include a heat transfer circuit with a compressor configured to compress a working fluid flowing through the heat transfer circuit.

SUMMARY

A heating, ventilation, air conditioning, and refrigeration ("HVACR") system can include a heat transfer circuit configured to heat or cool a process fluid (e.g., air, water and/or glycol, or the like). The heat transfer circuit includes a compressor that compresses a working fluid circulated through the heat transfer circuit. The compressor can include a housing, a shaft, and an impeller. The impeller includes a hub and impeller blades that extend from the hub. The impeller blades are configured to compress working fluid within the housing when rotated relative to the housing.

In an embodiment, the impeller includes external blades. The external blades are located along the exterior of the impeller. In an embodiment, the external blades are curved along an external surface of the impeller. In an embodiment, the hub or a shroud of the impeller is located between the impeller blades and the external blades.

In an embodiment, the external blades include rear external blades. The rear external blades protrude from a rear surface of the hub. The rear external blades protrude into a space between the hub of the impeller and the housing. In an embodiment, the hub is located between the impeller blades and the rear external blades. In an embodiment, an interior surface of the housing faces the hub and includes a notch. The rear external blades protrude into the notch. In an embodiment, the rear external blades include a first set of the rear external blades and a second set of the rear external blades.

In an embodiment, the external blades include front external blades. The front external blades protrude from an outer surface of a shroud of the impeller. The front external blades protrude into a space between the shroud of the impeller and the housing. In an embodiment, the shroud is located between the impeller blades and the front external blades. In an embodiment, an interior surface of the housing faces the shroud and includes a notch. The front external blades protrude into the notch. In an embodiment, the front external blades include a first set of the front external blades and second set of the front external blades.

BRIEF DESCRIPTION OF THE DRAWINGS

Both described and other features, aspects, and advantages of an impeller, a compressor including an impeller, and a heat transfer circuit including a compressor will be better understood with the following drawings.

Like reference characters refer to similar features.

DETAILED DESCRIPTION

A heating, ventilation, air conditioning, and refrigeration ("HVACR") system is generally configured to heat and/or cool an enclosed space (e.g., an interior space of a commercial or residential building, an interior space of a refrigerated transport unit, or the like). The HVACR system includes a heat transfer circuit that includes a compressor and a working fluid (e.g., a refrigerant, a refrigerant mixture, or the like) that circulates through the heat transfer circuit. The working fluid is utilized to heat or cool a process fluid (e.g., air, water and/or glycol, or the like).

The compressor includes a housing, a shaft, and an impeller that is rotatable relative to the housing by the shaft to compress the working fluid. The impeller is spaced apart from the housing to allow the impeller to be rotatable relative to the housing. This spacing forms passage(s) between the impeller and the housing that allow for leakage of compressed working fluid within the compressor. While the size of the passage(s) can be minimized, the minimized passage(s) still exist. Generally, the passage(s) are also sized to include tolerances for the movement of the impeller that can occur during operation of the compressor. The leakage of the compressed working fluid within the compressor causes an efficiency loss for the compressor.

Embodiments described herein are directed to impellers, compressors, and HVACR systems that include compressors, configured to minimize the flow through leakage passages along the impeller.

Figure 1:
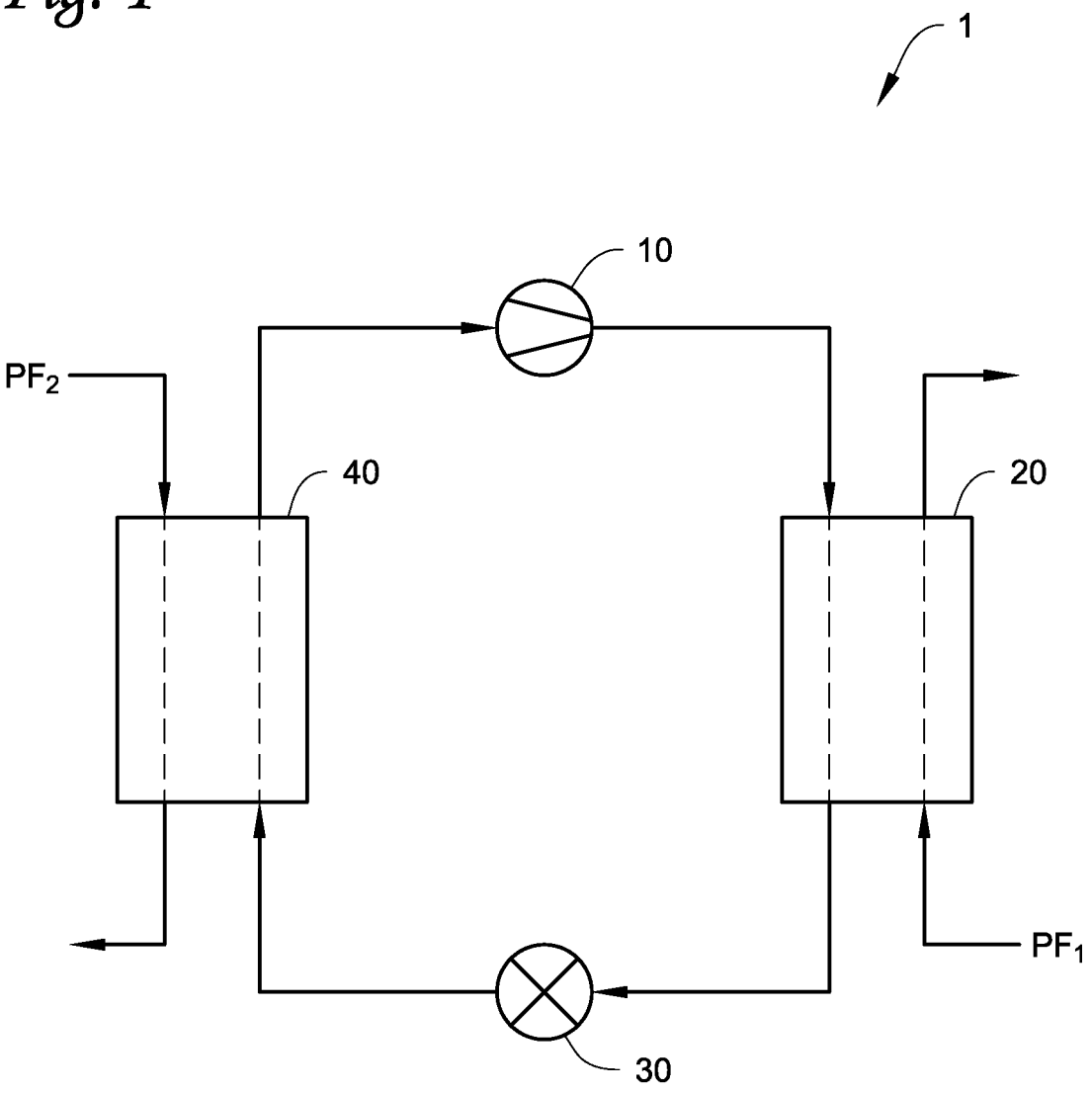
FIG. 1 is a schematic diagram of an embodiment of a heat transfer circuit.

FIG. 1 is a schematic diagram of a heat transfer circuit 1 of a HVACR system, according to an embodiment. The heat transfer circuit 1 includes a compressor 10, a condenser 20, an expansion device 30, and an evaporator 40. In an embodiment, the heat transfer circuit 1 can be modified to include additional components. For example, the heat transfer circuit 1 in an embodiment can include an economizer heat exchanger, one or more flow control devices, a receiver tank, a dryer, a suction-liquid heat exchanger, or the like.

The components of the heat transfer circuit 1 are fluidly connected. The heat transfer circuit 1 can be configured as a cooling system (e.g., a fluid chiller of an HVACR, an air conditioning system, or the like) that can be operated in a cooling mode, and/or the heat transfer circuit 1 can be configured to operate as a heat pump system that can run in a cooling mode and a heating mode.

The heat transfer circuit 1 applies known principles of gas compression and heat transfer. The heat transfer circuit can be configured to heat or cool a process fluid (e.g., water, air, or the like). In an embodiment, the heat transfer circuit 1 may represent a chiller that cools a process fluid such as water or the like. In an embodiment, the heat transfer circuit 1 may represent an air conditioner and/or a heat pump that cools and/or heats a process fluid such as air, water, or the like.

During the operation of the heat transfer circuit 1, a working fluid (e.g., refrigerant, refrigerant mixture, or the like) flows into the compressor 10 from the evaporator 40 in a gaseous state at a relatively lower pressure. The compressor 10 compresses the gas into a high pressure state, which also heats the gas. After being compressed, the relatively higher pressure and higher temperature gas flows from the compressor 10 to the condenser 20. In addition to the working fluid flowing through the condenser 20, a first process fluid $PF_1$ (e.g., external air, external water, chiller water, or the like) also separately flows through the condenser 20. The first process fluid absorbs heat from the working fluid as the first process fluid $PF_1$ flows through the condenser 20, which cools the working fluid as it flows through the condenser. The working fluid condenses to liquid and then flows into the expansion device 30. The expansion device 30 allows the working fluid to expand, which converts the working fluid to a mixed vapor and liquid state. An "expansion device" as described herein may also be referred to as an expander. In an embodiment, the expander may be an expansion valve, expansion plate, expansion vessel, orifice, or the like, or other such types of expansion mechanisms. It should be appreciated that the expander may be any type of expander used in the field for expanding a working fluid to cause the working fluid to decrease in temperature. The relatively lower temperature, vapor/liquid working fluid then flows into the evaporator 40. A second process fluid $PF_2$ (e.g., air, water, or the like) also flows through the evaporator 40. The working fluid absorbs heat from the second process fluid $PF_2$ as it flows through the evaporator 40, which cools the second process fluid $PF_2$ as it flows through the evaporator 40. As the working fluid absorbs heat, the working fluid evaporates to vapor. The working fluid then returns to the compressor 10 from the evaporator 40. The above-described process continues while the heat transfer circuit 1 is operated, for example, in a cooling mode.

Figure 2:
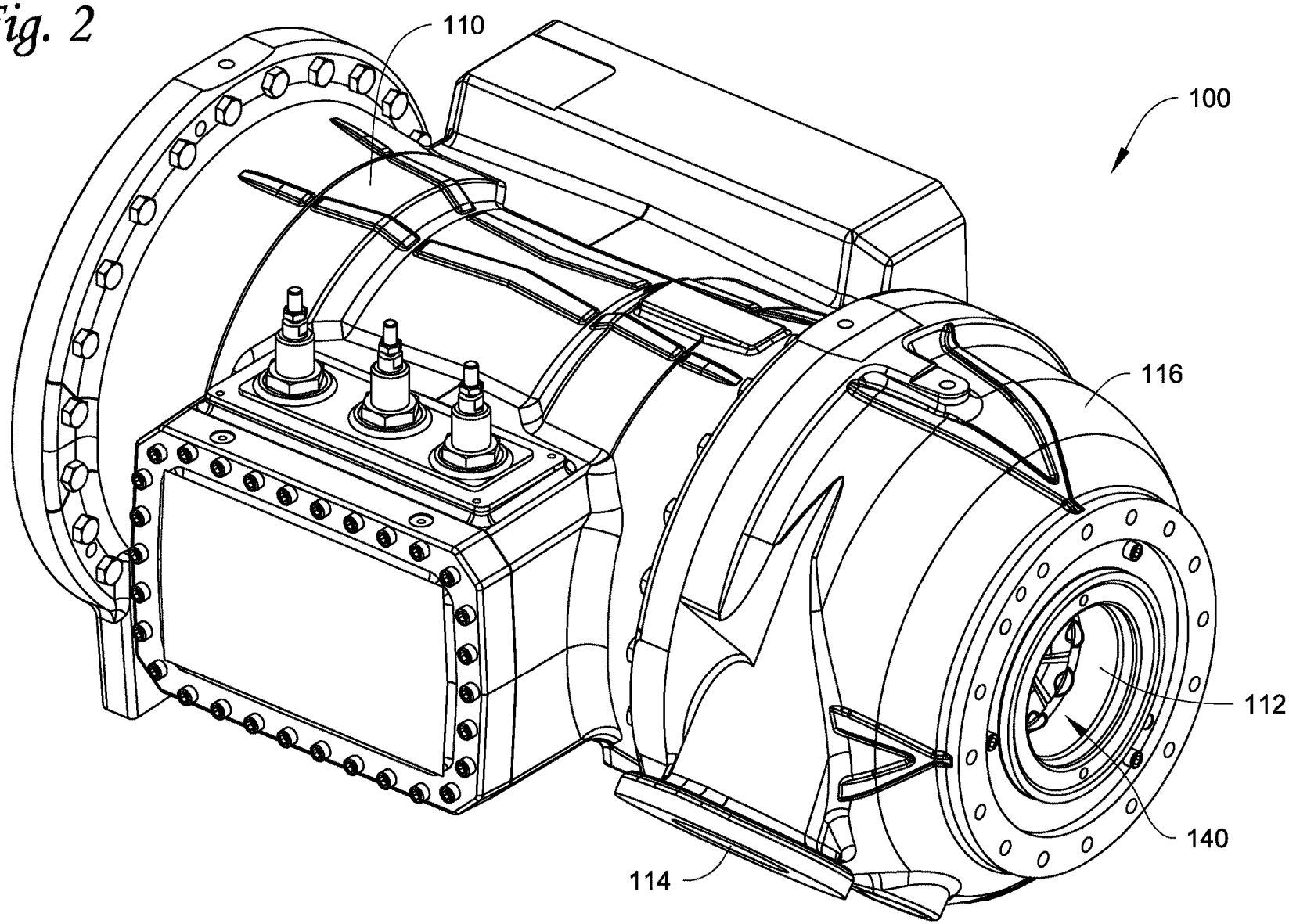
FIG. 2 is a front prospective view of an embodiment of a compressor.

FIG. 2 is a prospective view of an embodiment of a centrifugal compressor 100. In an embodiment, the compressor 100 is an embodiment of the compressor 10 in the heat transfer circuit 1 in FIG. 1. The compressor 100 includes a housing 110 and an impeller 140. The impeller 140 is discussed in more detail below. In an embodiment, the housing 110 includes an endcap 116 for the impeller 140. The compressor 100 includes an inlet 112 and an outlet 114. Working fluid to be compressed enters the compressor 100 through the inlet 112. The working fluid is compressed and discharged from the compressor 100 through the outlet 114.

Figure 3:
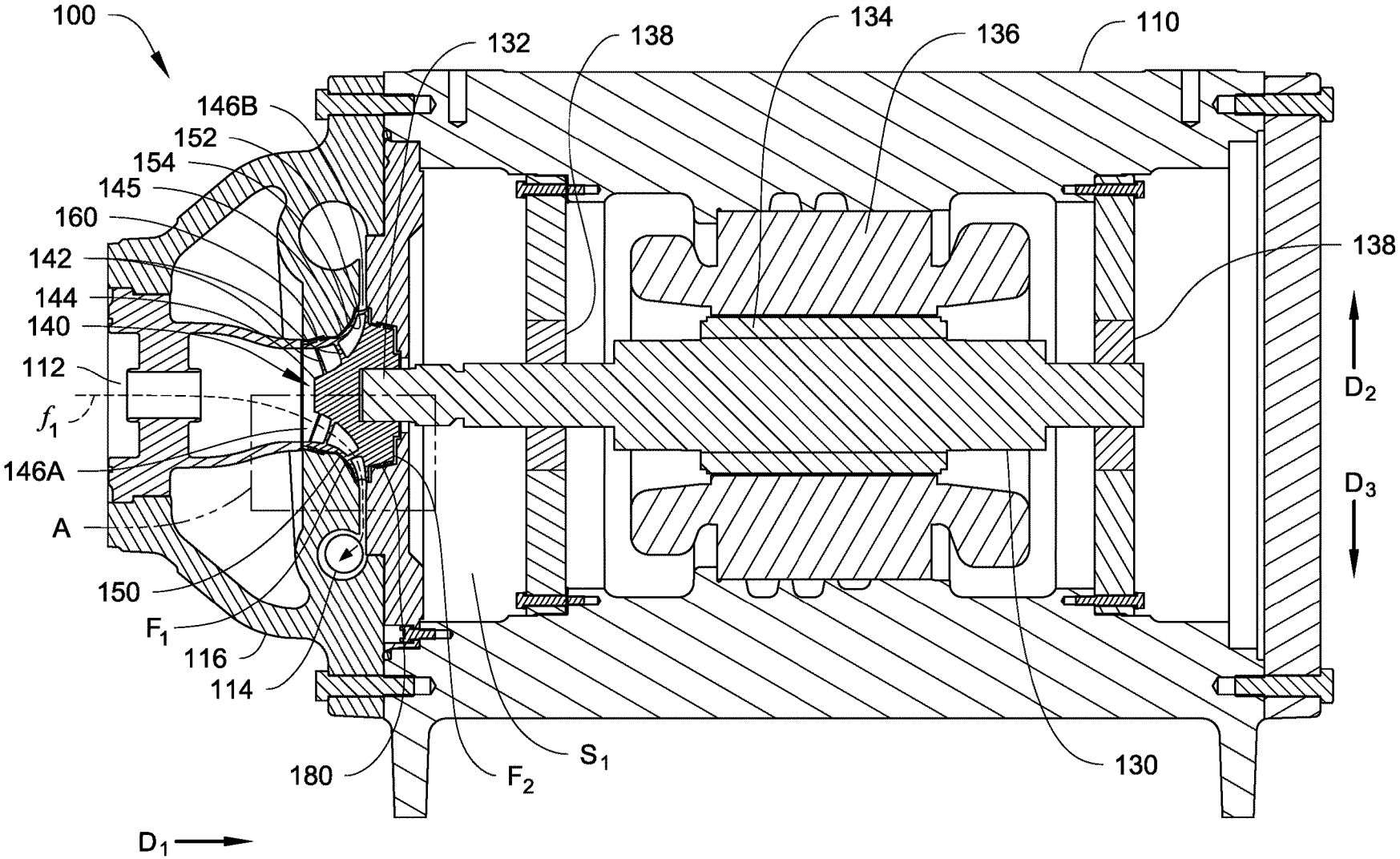
FIG. 3 is a cross-sectional view of the compressor in FIG. 2, according to an embodiment.

FIG. 3 is a cross-sectional view of the centrifugal compressor 100, according to an embodiment. For example, FIG. 3 shows a vertical cross section of the compressor 100 in FIG. 2. The compressor 100 in FIGS. 2 and 3 is a single stage compressor. However, the compressor 100 in an embodiment may be a multistage compressor. The compressor 100 includes a housing 110, the inlet 112, the outlet 114, a shaft 130, an impeller 140, a rotor 134, and a stator 136.

The impeller 140 is affixed to an end 132 of the shaft 130. The rotor 134 is attached to the shaft 130 and is rotated by the stator 136, which rotates the shaft 130 and the impeller 140. Bearings 138 support shaft 130 within the housing 110. In an embodiment, the housing 110 includes an endcap 116 for the impeller 140.

The impeller 140 includes impeller blades 142, a hub 144, and external blades 160, 180. The impeller 140 is rotated relative to the housing 110 by the shaft 130. The rotating impeller 140 compresses working fluid within housing 110. The main flow path is illustrated by the dashed arrow $f_1$. In the main flow path $f_1$, working fluid enters the compressor 100 through the inlet 112, is compressed by the impeller blades 142 of the rotating impeller 140, and is discharged from the compressor 110 through the outlet 114.

In an embodiment, the impeller 140 is a shrouded impeller that also includes a shroud 150. The impeller blades 142 extend from the front 145 of the hub 144. In an embodiment, one or more of the impeller blades 142 extends from the hub 144 to the shroud 150. The shroud 150 has an inner surface 152 and an outer surface 154. The inner surface 152 faces the hub 144. In an embodiment, the inner surface 152 faces the front 145 of the hub 144. The outer surface 154 is opposite to the inner surface 152 and faces the housing 110. In an embodiment, the impeller blades 142 extend towards the inner surface 152 of the shroud 150. The shroud 150 in FIG. 3 is a full shroud that extends entirely along the impeller blades 142 in the axial direction $D_1$. In an embodiment, the shroud 150 may be a partial shroud that only extends along a portion of the blades 142 in the axial direction $D_1$. In an embodiment, the impeller 140 may be a non-shrouded impeller that does not the shroud 150.

The impeller 140 includes a suction input 146A and discharge openings 146B. The working fluid enters the suction input 146A of the impeller 140 in the axial direction $D_1$. Compressed working fluid is radially discharged from the discharge openings 146B (e.g., discharged in direction $D_2$, discharged in direction $D_3$, or the like). The discharge openings 146B are gaps formed between the impeller blades 142.

The housing 110 is spaced apart from the impeller 140 to allow the impeller 140 to rotate relative to the housing 110. This spacing creates passages $F_1$, $F_2$ between the impeller 140 and the housing 110. Each of the passages $F_1$, $F_2$ extends along the impeller 140 and away from the discharge openings 146B of the impeller 140. Compressed working fluid attempts to flow through the passages $F_1$, $F_2$. The passages $F_1$, $F_2$ may be referred to as leakage passages $F_1$, $F_2$.

A first leakage passage $F_1$ is formed between the housing 110 and the shroud 150 of the impeller 140. The first leakage passage $F_1$ may be referred to as the shroud side leakage passage. Compressed working fluid can leak through the shroud side leakage passage $F_1$ to the suction input 146A of the impeller 140.

A second leakage passage $F_2$ is formed between the housing 110 and the hub 144 of the impeller 140. Compressed working fluid can leak through the second leakage passage $F_2$ to an internal space $S_1$ located behind the impeller 140 in the axial direction $D_1$. In an embodiment, the internal space $S_1$ is located along the shaft 130 of the compressor 100. In an embodiment, the passages $F_1$, $F_2$ each surround an entire circumference of the impeller 140.

In an embodiment, the impeller 140 includes front external blades 160 and rear external blades 180 located on the outside of the impeller 140. The front external blades 160 protrude from the outer surface 154 of the shroud 150. The rear external blades 180 protrude from a rear surface 148 of the hub 144.

Figure 4:
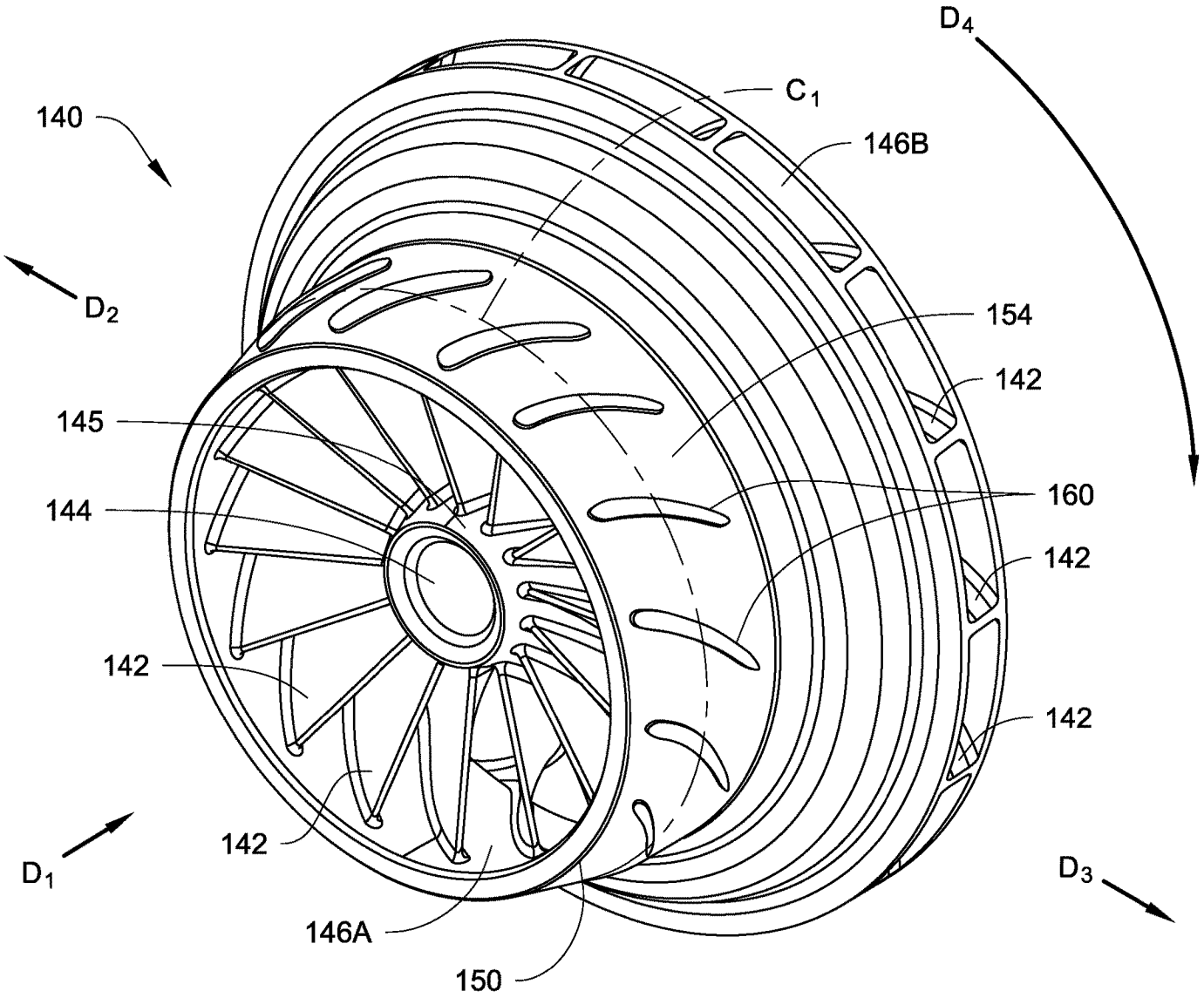
FIG. 4 is a front perspective view of an impeller of the compressor in FIG. 3, according to an embodiment.

FIG. 4 is a front perspective view of the shrouded impeller 140 in an embodiment. The impeller 140 includes the impeller blades 142, the discharge openings 146B, and the front external blades 160. The impeller blades 142 extend along the front hub 144. The impeller blades 142 extend both the axial direction $D_1$ and the circumferential direction $D_4$ along the hub 144. Thus, the impeller blades 142 are have a curved shape along the hub 144. In an embodiment, the impeller blades 144 and the shroud 150, via the impeller blades 144, are attached to the front 145 of the hub 144. In an embodiment, the hub 144 may include a slot for attaching an inlet guide vane (not shown).

The front external blades 160 protrude from the outer surface 154 of the shroud 150. The front external blades 160 extend along the outer surface 154 of the shroud 150. Each of the front external blades 160 curves along the outer surface 154 relative to the axial direction $D_1$ of the impeller 140. In an embodiment, the front external blades 160 curve in the same circumferential direction $D_4$ as the impeller blades. In an embodiment, the front external blades 160 extend in both the axial direction $D_1$ and the circumferential direction $D_4$ along the outer surface 154. As the front external blades 160 curve, they do not extend directly in the axial direction $D_1$ or directly in the circumferential direction $D_4$ along the outer surface 154. In an embodiment, the front external blades 160 extend to have a concave or convex shape along the outer surface 154. In an embodiment, the front external blades 160 are positioned in the axial direction $D_1$ so as to be overlapping a single circumference $C_1$ of the impeller 140. In an embodiment, the circumference $C_1$ extends along a plane perpendicular to the axial direction $D_1$. The front external blades 160 are aligned in the circumferential direction $D_4$ of the impeller 140.

The impeller 140 includes a plurality of the front external blades 160. In an embodiment, the impeller 140 includes at least two of the front external blades 160. In an embodiment, the impeller 140 includes at least four of the front external blades 160. In an embodiment, at least one of the front external blades 160 is provided in each 90 degree portion along the circumference $C_1$ of the impeller 140. In an embodiment, the impeller 140 includes at least eight of the front external blades 160. In an embodiment, at least one of the front external blades 160 is provided in each 45 degree portion along the circumference $C_1$ of the impeller 140.

Figure 5:
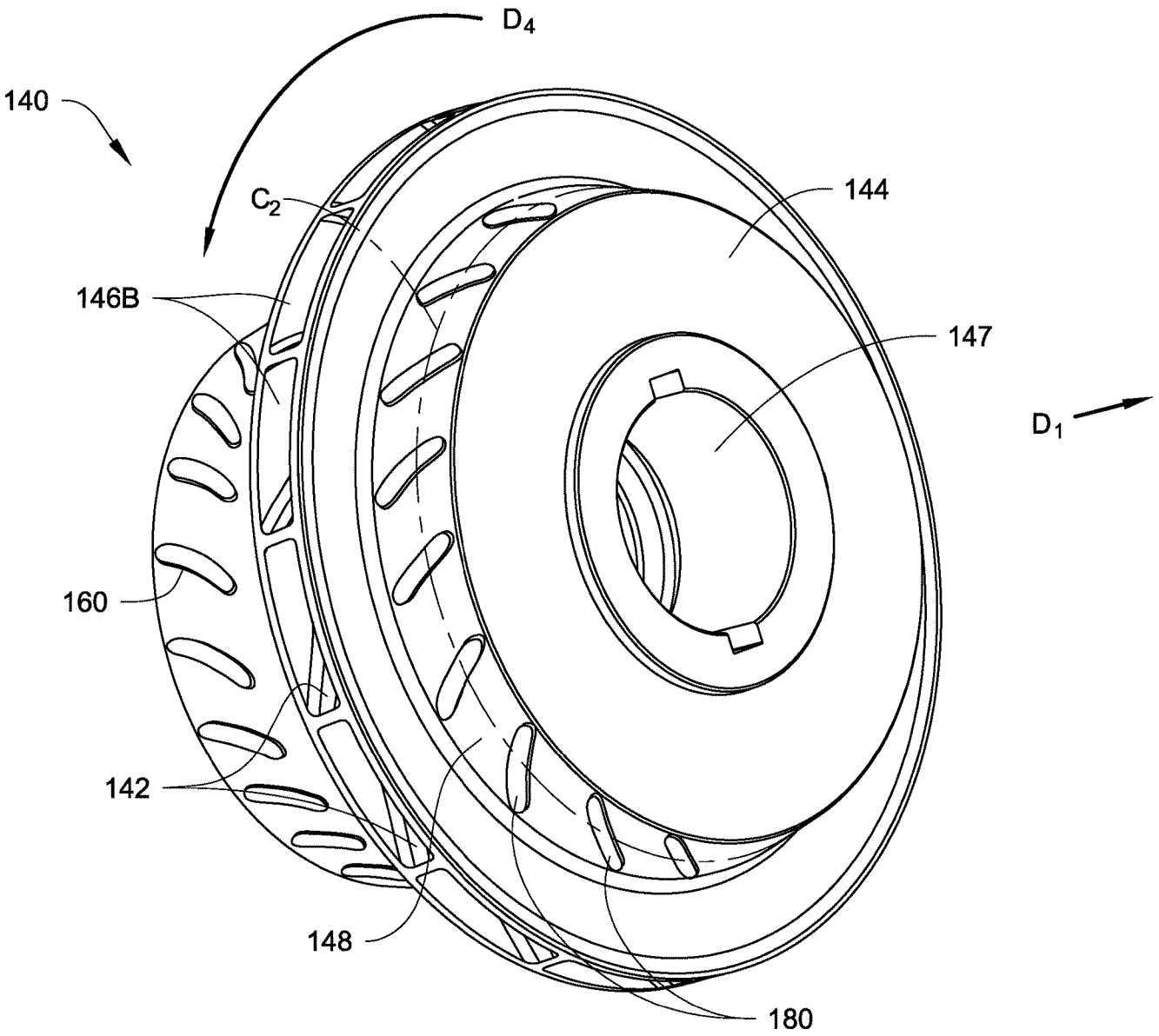
FIG. 5 is a rear perspective view of the impeller of the compressor in FIG. 3, according to an embodiment

FIG. 5 is a rear perspective view of the shrouded impeller 140 in an embodiment. The impeller 140 includes the impeller blades 142, the hub 144, the discharge openings 146B, and the rear external blades 180. The hub 144 includes an opening 147 into which the end 132 of the shaft 130 (shown in FIG. 3) is inserted to attach hub 144 to the shaft 130.

As shown in FIG. 5, the rear external blades 180 protrude from the rear surface 148 of the impeller 140. In an embodiment, the rear surface 148 is located rearward of the discharged openings 146B in the axial direction $D_1$ of the impeller 140. The rear external blades 180 are each curved along the rear surface 148 relative to the axial direction $D_1$. In an embodiment, the rear external blades 180 each extend in both the axial direction $D_1$ and in the circumferential direction $D_4$ along the rear surface 148. As the rear external blades 180 are curved, they do not extend directly in the axial direction $D_1$ or directly in the circumferential direction $D_4$ along the rear surface 148. In an embodiment, the rear external blades 180 extend to have a concave or convex shape along the rear surface 148. In an embodiment, the rear external blades 180 are positioned in the axial direction $D_1$ so as to be overlapping a single circumference $C_2$ of the impeller 140. In an embodiment, the circumference $C_2$ is along a plane perpendicular to the axial direction $D_1$. In an embodiment, the rear external blades 180 are aligned in the circumferential direction $D_4$ of the impeller 140.

The impeller 140 includes a plurality of the rear external blades 180. In an embodiment, the impeller 140 includes at least two of the rear external blades 180. In an embodiment, the impeller 140 includes at least four of the rear external blades 180. In an embodiment, at least one of the rear external blades 180 is provided in each 90 degree portion along the circumference $C_2$ of the impeller 140. In an embodiment, the impeller 140 includes at least eight of the rear external blades 180. In an embodiment, at least one of the rear external blades 180 is provided in each 90 degree portion along the circumference $C_2$ of the impeller 140.

Figure 6:
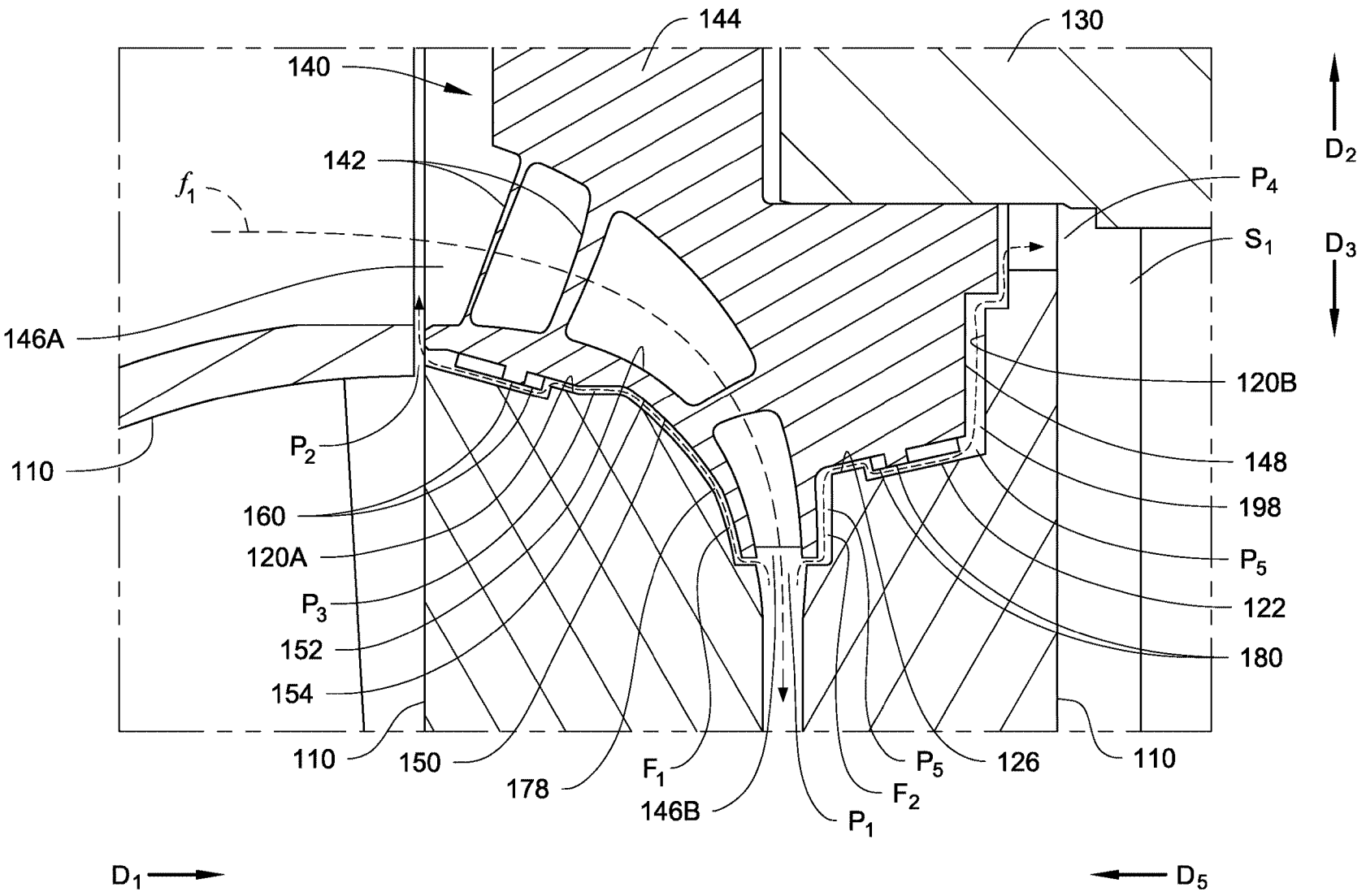
FIG. 6 is enlarged view of area A in the cross-sectional view in FIG. 3, according to an embodiment.

FIG. 6 is an enlarged view of the area A in FIG. 3. FIG. 6 shows an enlarged view of a cross section of the leakage passages $F_1$, $F_2$. During operation, the shaft 130 rotates the impeller 140 causing the impeller blades 142 to rotate. As shown by the main flow path $f_1$ in FIG. 6, the working fluid enters the impeller 140 in the axial direction $D_1$ and compressed working fluid is radially discharged from discharge openings 146B between the impeller blades 142 (e.g., discharged in the direction $D_2$, discharged in the direction $D_3$, or the like).

The shroud side leakage passage $F_1$ extends along the outer surface 154 of the shroud 150 between the outer surface 154 of the shroud 150 and a first interior surface 120A of the housing 110. The first interior surface 120A faces the outer surface 154 of the shroud 150. The shroud side leakage passage $F_1$ extends between the discharge openings 146B and the suction input 146A of the impeller 140. The compressed working fluid discharged from the impeller 140 has a pressure $P_1$ that is significantly greater than the pressure $P_2$ of the working fluid entering the impeller 140. This pressure difference ($P_1$−P2) causes the compressed working fluid to flow through the shroud side leakage passage $F_1$ from the main flow path $f_1$. This compressed working fluid flows to the suction input 146A instead of to the outlet 114 (shown in FIG. 3) of the compressor 100.

As shown in FIG. 6, the front external blades 160 protrude from the shroud 150 into the space 178 of the shroud side leakage passage $F_1$. The front external blades 160 rotate with the impeller 140. When the impeller 140 is rotated, the rotating front external blades 160 create a higher pressure $P_3$ within the shroud side leakage passage $F_1$. In an embodiment, the rotating front external blades 160 are configured to drive fluid in the axial direction $D_1$ within the shroud side leakage passage $F_1$ towards the discharge openings 146B. In an embodiment, compressed fluid may still flow through the leakage passage $F_1$ but at a reduced rate. The higher pressure $P_3$ in the shroud side leakage passage $F_1$ can result in a lower pressure difference between the compressed working fluid discharged from the discharge openings 146B and the shroud side leakage passage $F_1$ ($P_1-P_3<P_1-P_2$). The lower pressure difference can advantageously reduce the flow rate of compressed working fluid through the shroud side leakage passage $F_1$ and can result in better sealing.

The front external blades 160 in FIG. 6 extend along a portion of the shroud side leakage passage $F_1$. For example, the front external blades 160 in FIG. 6 extend along at or about 25% of the shroud side leakage passage $F_1$. However, it should be appreciated that the front external blades 160 in an embodiment may extend along a different amount of the shroud side leakage passage $F_1$ than is shown in FIG. 6. In an embodiment, the front external blades 160 may extend from at or about 10% to at or about 100% of the shroud side leakage passage $F_1$. In an embodiment, the front external blades 160 may extend along at least 10% of the shroud side leakage passage $F_1$. In an embodiment, one or more of the front external blades 160 may extend along at least 25% of the shroud side leakage passage $F_1$. In an embodiment, one or more of the front external blades 160 may extend along a majority of the shroud side leakage passage $F_1$. In an embodiment, the front external blades 160 may have different lengths. For example, the front external blades 160 in an embodiment may include one or more splitter blades that have a shorter length along the shroud 150 and begin farther downstream in the shroud side leakage passage $F_1$.

The hub side leakage passage $F_2$ extends along the impeller 140 between a rear surface 148 of the hub 144 of the impeller 140 and a second interior surface 120B of the housing 110. The second interior surface 120B faces the rear surface 148 of the impeller 140. The second leakage passage $F_2$ extends between the discharge openings 146B and an internal space $S_1$ of the compressor 100. In an embodiment, the internal space $S_1$ is located along the shaft 130 of the compressor 100. The compressed working fluid discharged from the impeller 140 has a pressure $P_1$ that is greater than the pressure $P_4$ of the internal space $S_1$. This pressure difference ($P_1-P_4$) causes the compressed working fluid to flow through the second leakage passage $F_2$ into the interior space $S_1$. This compressed working fluid leaks into interior space $S_1$ instead of flowing to the outlet 114 (shown in FIG. 3) of the compressor 100. In an embodiment, the compressed working fluid in the interior space $S_1$ eventually flows back into the suction input 146A of the impeller 140.

As shown in FIG. 6, the rear external blades 180 protrude from the hub 144 of the impeller 140. The rear external blades 180 protrude into the space 198 of the second leakage passage $F_2$. The rear external blades 180 are rotated as the impeller 140 is rotated. The rotating rear external blades 180 create a higher pressure $P_5$ within the second leakage flow path $F_2$. In an embodiment, the rotating rear external blades 180 are configured to drive fluid in the axial direction $D_5$ within the hub side leakage passage $F_2$ towards the discharge openings 146B. In an embodiment, compressed fluid may still flow through the leakage passage $F_2$ but at a reduced rate. The higher pressure $P_5$ can result in a lower pressure difference between the compressed working fluid discharged from the discharge openings 146B and the hub side passage $F_2$ (e.g., $P_1-P_5<P_1-P_4$). The lower pressure difference can advantageously reduce the flow rate of compressed working fluid through the leakage passage $F_2$ and can result in better sealing.

In an embodiment, the housing 110 includes a notch 122 for the rear external blades 180. The notch 122 is formed in the second interior surface 120B of the housing 110. The rear external blades 180 protrude from the rear surface 148 into the notch 122. In an embodiment, the notch 122 extends along an entire circumference $C_2$ (shown in FIG. 5) of the impeller 140. In an embodiment, the notch 122 when viewed in the axial direction $D_1$ may have an elliptical and/or oval shape. The notch 122 provides additional space between the housing 110 and the impeller 140 for the rear external blades 180. A contraction 126 is formed adjacent to the notch 122. The contraction 126 causes a pressure drop for working fluid flowing through the contraction 126 that can advantageously further decreases the flow of working fluid through the hub side leakage passage $F_2$.

The rear external blades 180 in FIG. 6 extend along a portion of the hub side leakage passage $F_2$. For example, the rear external blades 180 in FIG. 6 extend along approximately 20% of the hub side leakage passage $F_2$. However, it should be appreciated that the rear external blades 180 in an embodiment may extend along a different amount of the hub side leakage passage $F_2$ shown in FIG. 6. In an embodiment, the rear external blades 180 may extend from at or about 10% to at or about 100% of the hub side leakage passage $F_2$. In an embodiment, the rear external blades 180 may extend along at least 10% of the hub side leakage passage $F_2$. In an embodiment, one or more of the rear external blades 180 may extend along at least 25% of the hub side leakage passage $F_2$. In an embodiment, one or more of the rear external blades 180 may extend along a majority of the hub side leakage passage $F_2$. In an embodiment, the rear external blades 180 may have different lengths. For example, the rear external blades 180 in an embodiment may include one or more splitter blades with a shorter length along the impeller 140 and begin farther downstream in the hub side leakage passage $F_2$.

In an embodiment, the impeller 140 may be a non-shrouded impeller that includes the rear external blades 180. The rear external blades 180 configured to reduce leakage through the hub side leakage passage $F_2$ in the non-shrouded impeller. The external blades 160, 180 provide a specific thrust force in the axial directions $D_1$, $D_5$. In an embodiment, external blades 160, 180 may help control the amount of thrust in an axial direction $D_1$, $D_5$. In an embodiment, the external blades 160, 180 have a configuration (e.g., length, location, curvature, number, or the like) that allows for reducing the axial thrust generated the impeller blades 142 during operation. For example, the configuration of the external blades 160, 180 can help reduce the amount of thrust applied in the axial direction $D_1$ to thrust bearing(s) (not shown) of the compressor 100.

Figure 7:
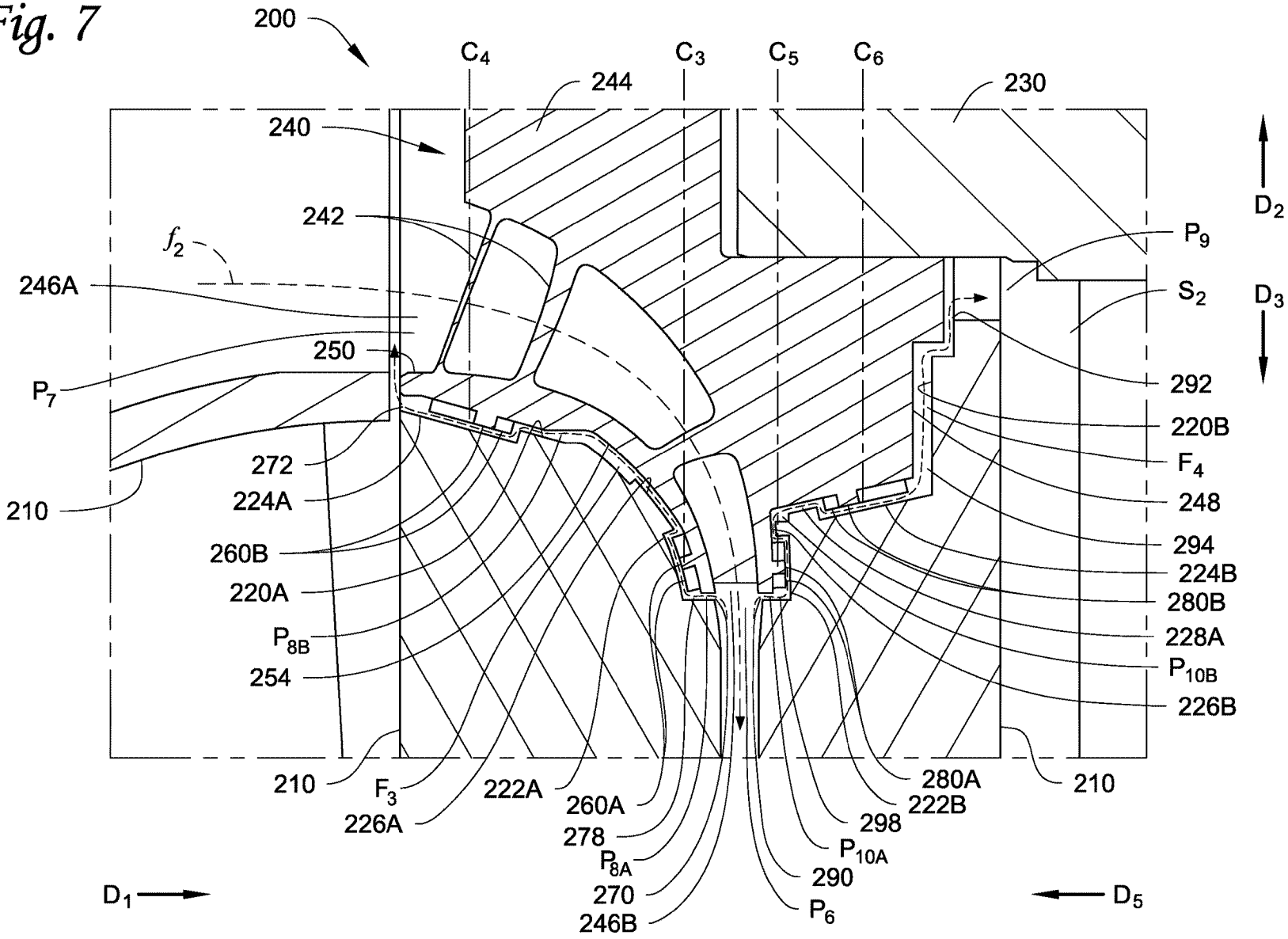
FIG. 7 is a partial cross-sectional view of an embodiment of a compressor.

FIG. 7 is a partial cross-sectional view of an embodiment of a compressor 200 that includes an impeller 240. In an embodiment, the view in FIG. 7 is a view of the compressor 200 similar to the view in FIG. 8 of its respective compressor 100. In an embodiment, the impeller 240 is a shrouded impeller that includes a shroud 250. The impeller 240 includes front external blades 260A, 260B and rear external blades 280A, 280B. In an embodiment, the impeller 240 is a similar to the impeller 140 in FIGS. 3-6 and as described above, except with respect to the external blades 260A, 260B, 280A, 280B. For example, the impeller 240 includes impeller blades 242, a hub 244 with a rear surface 248, the shroud 250 with an outer surface 254, a suction input 246A, discharge openings 246B. In an embodiment, the compressor 200 is similar to the compressor 100 in FIGS. 3-6 and as described above, except with respect to a first interior surface 220A and a second interior surface 220B of the housing 210 that face the impeller 240. For example, the compressor 200 includes a housing 210, a shaft 230 for rotating the impeller 240, a main flow path $f_2$, and an internal space $S_2$.

As shown in FIG. 7, $f_2$ illustrates a portion of the main flow path for the working fluid through the compressor 200. Working fluid to be compressed flows into the suction input 246A of the rotating impeller 240 in the axial direction $D_1$. The working fluid is compressed by the rotating impeller blades 242 and is radially discharged from discharge openings 246B between the impeller blades 242 (e.g., discharged in direction $D_2$, discharged in direction $D_3$, or the like). The housing 210 is spaced apart from the impeller 240 to allow the impeller 240 to be rotatable relative to the housing 210. This spacing forms passages $F_3$, $F_4$ between the housing 210 and the impeller 240.

A shroud side leakage passage $F_3$ extends along the shroud 250 between the outer surface 254 of the shroud 250 and a first interior surface 220A of the housing 210. A hub side leakage passage $F_4$ extends along the hub 244 between the rear surface 248 of the impeller 240 and a second interior surface 220B of the housing 210. The leakage passages $F_3$, $F_4$ are similar to the leakage passages $F_1$, $F_2$ in FIGS. 3-6 and as described above, respectively, except with respect to the interior surfaces 220A, 220B of the housing 210 and the external blades 260A, 260B, 280A, 280B.

The front external blades 260A, 260B protrude from the outer surface 254 of the shroud 250. The front external blades 260A, 260B protrude into the space of the shroud side leakage passage $F_3$. The front external blades 260A, 260B include a first set of front external blades 260A and a second set of front external blades 260B. In an embodiment, the second set of front external blades 260B are similar to the front external blades 160 in FIGS. 3-6. In an embodiment, the front external blades 260A, 260B have a similar structure to the front external blades 160 in FIGS. 3 and 4 and as described above, except with respect to location within the shroud side leakage passage $F_3$. For example, the front external blades 260A, 260B in an embodiment have a curvature similar to the curvature as shown in FIGS. 3 and 4 and described above for the front external blades 160.

The compressed working fluid is discharged with a pressure $P_6$ that is greater than the pressure $P_7$ of the working fluid flowing into the suction input 246A. The front external blades 260A, 260B rotate with the impeller 240. In an embodiment, the rotating front external blades 260A, 260B are each configured to drive fluid in the axial direction $D_1$ within the shroud side leakage passage $F_3$ towards the discharge openings 246B. The first set of front external blades 260A increase a pressure $P_{8A}$ at the entrance 278 of the shroud side leakage passage $F_3$. The second set of front external blades 260B increase a pressure $P_{8B}$ within the shroud side leakage passage $F_3$. In an embodiment, compressed fluid may still flow through the shroud side leakage passage $F_3$ but at a reduced rate. In a similar manner as discussed above with respect to the front external blades 160, the increased pressures $P_{8A}$, $P_{8B}$ can result in a lower pressure difference that can advantageously reduce the flow rate of compressed working fluid through the shroud leakage flow path $F_3$ and can result in better sealing.

The first set of front external blades 260A is spaced apart from the second set of front external blades 260A in shroud side leakage passage $F_3$. In an embodiment, the first set of front external blades 260A is located at a first end 270 of the shroud side leakage passage $F_3$. In an embodiment, the second set of front external blades 260B is located at a second end 272 of the shroud side leakage passage $F_3$ opposite to the first end 270. The first end 270 is located closer to the discharge openings 246B than the second end 272. In an embodiment, the first set of front external blades 260A are arranged along a first circumference $C_3$ of the impeller 240, and the second set of front external blades 260B are arranged along a second circumference $C_4$ of the impeller 240. The first circumference $C_3$ and second circumference $C_4$ are spaced apart in the axial direction $D_1$. In an embodiment, the circumference $C_3$ and the second circumference $C_4$ are each along a respective plane perpendicular to the axial direction $D_1$.

It should be appreciated that front external blades 260A, 260B in an embodiment may have different locations in the shroud side leakage passage $F_3$ than is shown in FIG. 7. In an embodiment, the first set of front external blades 260A and/or the second set of front external blades 260A may be positioned between the first end 270 and the second end 272 of the shroud side leakage passage $F_3$. In an embodiment, the front external blades 260A, 260B may include third front external blades (not shown) that are located between the first set of front external blades 260A and the second set of front external blades 260B within the shroud side leakage passage $F_3$.

In an embodiment, the housing 210 includes a notch 222A for the first set of front external blades 260A and a separate notch 224A for the second set of front external blades 260A. Each of the notches 222A, 224A is formed in the first interior surface 220A of the housing 210. In an embodiment, each of the notches 222A, 224A extends along an entire circumference $C_3$, $C_4$ of the impeller 140. In an embodiment, each of the notches 222A, 224A when viewed in the axial direction $D_1$ may have an elliptical and/or oval shape. The first set of front external blades 260A protrude from the outer surface 254 of the shroud 250 into the notch 222A. The second set of front external blades 260B protrude from the outer surface 254 of the shroud 250 into the notch 224A. The notches 222A, 224A each provide additional space between the housing 210 and the impeller 240 for their respective front external blades 260A, 260B. A contraction 226A is formed adjacent to the notch 222A. The contraction 226A causes a pressure drop for working fluid flowing through the contraction 226A that can advantageously further decrease the flow of working fluid through the shroud side leakage passage $F_3$.

The rear external blades 280A, 280B protrude from the rear surface 248 of the impeller 240. The rear external blades 280A, 280B protrude from the rear surface 248 of the hub 244 of the impeller 240. The rear external blades 280A, 280B protrude into the space of the hub side leakage passage $F_3$. The side leakage passage $F_3$ extends between the discharge openings 246B and an internal space $S_2$ behind the impeller 240. The internal space $S_2$ is at lower pressure $P_9$ than the pressure $P_6$ of the compressed working fluid discharged from the impeller 240. In an embodiment, the internal space $S_2$ is similar to the internal space $S_1$ in FIGS. 3 and 6 and as discussed above.

The rear external blades 280A, 280B include a first set of the rear external blades 280A and second set of the rear external blades 280B. In an embodiment, the second set of rear external blades 280B is similar to the rear external blades 180 in FIGS. 3, 5, and 6. In an embodiment, the rear external blades 280A, 280B have a similar structure to the rear external blades 180 in FIGS. 3 and 5 and as described above, except with respect to their location within the hub side leakage passage $F_4$. For example, the rear external blades 280A, 280B in an embodiment have a curvature similar to the curvature shown in FIGS. 3 and 5 and as described above for the rear external blades 180.

The rear external blades 280A, 280B rotate with the impeller 240. In an embodiment, the rotating rear external blades 280A, 280B are each configured to drive fluid in the axial direction $D_5$ within the shroud side leakage passage $F_3$ towards the discharge openings 246B. The first set of rear external blades 280A increase a pressure $P_{10A}$ at the entrance 298 of the hub side leakage passage $F_4$. The entrance 298 of the hub side leakage passage $F_4$ is along the discharge openings 246B. The second set of rear external blades 280B increase a pressure $P_{10B}$ within the hub side leakage passage $F_4$. In an embodiment, compressed fluid may still flow through the hub side leakage passage $F_4$ but at a reduced rate. In a similar manner as discussed above with respect to the rear external blades 180 in FIG. 5, the increased pressures $P_{10A}$, $P_{10B}$ can result in a lower pressure difference that can advantageously reduce the flow rate of compressed working fluid through the hub side leakage flow path $F_4$ and can result in better sealing.

As shown in FIG. 7, the first set of rear external blades 280A is spaced apart from the second set of rear external blades 280B within hub side leakage passage $F_4$. In an embodiment, the first set of rear external blades 280A is located at a first end 290 of the hub side leakage passage $F_4$. In an embodiment, the second set of rear external blades 280B is located closer to a second end 292 of the hub side leakage passage $F_4$ than the first set of rear external blades 280A within the hub side leakage passage $F_4$. The second end 292 is opposite to the first end 290. In an embodiment, the second set of rear external blades 280B is located in a middle portion 294 of the hub side leakage passage $F_4$ that is between the first end 290 and the second end 292. In an embodiment, the first set of rear external blades 280A are located along a first circumference $C_5$ of the impeller 240, and the second set of rear external blades 280B are provided along a second circumference $C_6$. The first circumference $C_5$ and second circumference $C_6$ are spaced apart in the axial direction $D_1$. In an embodiment, the circumference $C_5$ and the second circumference $C_6$ are each along a respective plane perpendicular to the axial direction $D_1$.

It should be appreciated that rear external blades 280A, 280B in an embodiment may have different locations in the hub side leakage passage $F_4$ than is shown in FIG. 7. In an embodiment, the first set of rear external blades 280A and/or the second set of rear external blades 280B may be positioned at the second end 290 of the hub side leakage passage $F_4$. In an embodiment, the rear external blades 280A, 280B may include third rear external blades (not shown) that are located at the second end 290 of the hub side leakage passage $F_4$. In such an embodiment, the third rear external blades may be positioned in the hub side leakage passage $F_4$ in a similar manner to the position of the second set of rear external blades 280B in the shroud side passage $F_3$.

In an embodiment, the housing 210 includes a notch 222B for the first set of rear external blades 280A and a separate notch 224B for the second set of rear external blades 280B. Each of the notches 222B, 224B is formed in the second interior surface 220B of the housing 210. In an embodiment, each of the notches 222B, 224B extends along an entire circumference $C_5$, $C_6$ of the impeller 140. In an embodiment, each of the notches 222B, 224B when viewed in the axial direction $D_1$ may have an elliptical and/or oval shape. The notches 222B, 224B each provide additional space between the housing 210 and the impeller 240 for their respective rear external blades 280A, 280B. The first set of rear external blades 280A protrude from the rear surface 248 of the hub 244 into the notch 222B. The second set of rear external blades 280B protrude from the rear surface 248 of the hub 244 into the notch 224B. A contraction 226B is formed adjacent to the notch 222B. In an embodiment, a contraction 228B is formed adjacent to the adjacent to the notch 224B. Each of the contractions 226B, 228B causes a pressure drop for working fluid when flowing through the respective contraction 226B, 228B that can advantageously further decrease the flow of working fluid through the hub side leakage passage $F_4$.

Figure 8:
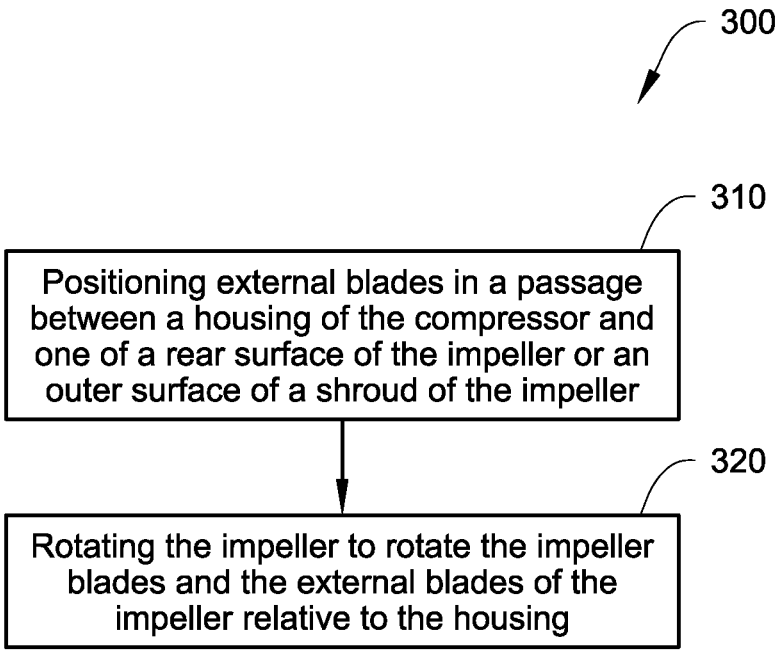
FIG. 8 is a block diagram of an embodiment of a method of providing sealing between an impeller and a housing in a compressor.

FIG. 8 is a block diagram of an embodiment of a method 300 of providing sealing between an impeller and a housing in a compressor. For example, the method 300 may be for providing sealing between the impeller and the housing in the compressor 100 in FIG. 2, or in the compressor 200 in FIG. 7. In an embodiment, the compressor is employed in a heat transfer circuit (e.g., the heat transfer circuit 1 of FIG. 1) of an HVACR system. The method 300 starts at 310.

At 310, external blades (e.g., front external blades 160, 260A, 260B, rear external blades 280, 260A, 260B) are positioned in a passage (e.g., passage F1, F2, F3, F4) that is between the housing (e.g., housing 110, 210) of the compressor and one of a rear surface (e.g., rear surface 148, 248) or an outer surface (e.g., outer surface 154, 254) of a shroud (e.g., shroud 150, 250) of the impeller (e.g., impeller 140, 240). In an embodiment, the external blades positioned so as to increase a pressure (e.g., $P_3$, $P_5$, $P_{8A}$, $P_{8B}$, $P_{10A}$, $P_{10B}$) within the passage or at an entrance to the passage when the impeller is rotated relative to the housing. The method 300 then proceeds to 320.

At 320, the impeller is rotated to rotate the external blades and impeller blades (e.g., impeller blades 142, 242) of the impeller relative to the housing. The impeller discharges compressed working fluid by the rotating impeller blades compressing working fluid. Working fluid in the passage 140 is a portion of the compressed working fluid discharged from the impeller 140. In an embodiment, the rotating external blades are configured to drive compressed working fluid within the passage in an axial direction (e.g., in direction $D_1$, $D_5$) towards discharge outlets of the impeller (e.g., discharge outlets 146B, 246B). The rotating external blades increase a pressure (e.g., $P_3$, $P_5$, $P_{8A}$, $P_{8B}$, $P_{10A}$, $P_{10B}$) within the passage or at an entrance to the passage. In an embodiment, a portion of the compressed working fluid flows through the passage and along the external blades. The increased pressure caused by the rotating external blades reduces the flow of compressed working fluid through the passage and thereby reduces leakage and improves sealing between the impeller and the housing.

In an embodiment, the method 300 may be modified based on the compressor 100, the compressor 200, the impeller 140, and/or impeller 240 as shown FIGS. 3-7 and as described above.

Aspects:

Any of aspects 1-8 can be combined with any of aspects 9-17, and any of aspects 9-16 can be combined with aspect 17.

Aspect 1. A compressor, comprising:

a housing;

a shaft with an end; and an impeller rotatable relative to the housing by the shaft, the impeller including:

a hub attached to the end of the shaft, the hub including a rear surface, impeller blades extending from a front of the hub, and external blades protruding from one of the rear surface of the hub and an outer surface of a shroud of the impeller, the external blades being curved along the one of the rear surface of the hub and the outer surface of the shroud of the impeller.

Aspect 2. The compressor of aspect 1, wherein the external blades include a first set of the external blades and a second set of the external blades, the first set of the external blades spaced apart from the second set of the external blades in an axial direction.

Aspect 3. The compressor of either one aspect 1 or 2, wherein the housing includes an interior surface with a notch, the interior surface facing the one of the rear surface of the hub and the outer surface of the shroud, the external blades protruding into the notch.

Aspect 4. The compressor of any one of aspects 1-3, further comprising:

the shroud including an inner surface opposite to the outer surface, at least one of the impeller blades extending from the front of the hub to the inner surface of the shroud, wherein the external blades protrude from the outer surface of the shroud and extend along the outer surface.

Aspect 5. The compressor of aspect 4, wherein the housing includes an interior surface facing the outer surface of the shroud, the external blades protruding from the outer surface of the shroud into a space between the interior surface of the housing and the outer surface of the shroud.

Aspect 6. The compressor of either one of aspects 4 or 5, wherein the shroud is located between the impeller blades and the external blades.

Aspect 7. The compressor of any one of aspects 1-6, wherein the external blades protrude from the rear surface of the hub and extend along the rear surface.

Aspect 8. The compressor of aspect 7, wherein the housing includes an interior surface that faces the rear surface of the impeller, the external blades disposed in a space between the interior space of the housing and the rear surface of the impeller.

Aspect 9. A heat transfer circuit, comprising:

a compressor including:

a housing;

a shaft with an end; and an impeller rotatable relative to the housing by the shaft to compress a working fluid, the impeller including:

a hub attached to the end of the shaft, the hub including a rear surface, impeller blades extending from a front of the hub, and external blades protruding from one of the rear surface of the hub and an outer surface of a shroud of the impeller, the external blades being curved along the one of the rear surface of the hub and the outer surface of the shroud of the impeller;

a condenser for cooling the working fluid compressed by the compressor;

an expander for expanding the working fluid cooled by the condenser; and an evaporator for heating the working fluid expanded by the expansion device with a process fluid.

Aspect 10. The heat transfer circuit of aspect 9, wherein the external blades include a first set of the external blades and a second set of the external blades, the first set of the external blades spaced apart from the second set of the external blades in an axial direction.

Aspect 11. The heat transfer circuit of either one of aspects 9 or 10, wherein the housing includes an interior surface with a notch, the interior surface facing the one of the rear surface of the hub and the outer surface of the shroud, the external blades protruding into the notch.

Aspect 12. The heat transfer circuit of any one of aspects 9-11, further comprising:

the shroud including an inner surface opposite to the outer surface, at least one of the impeller blades extending from the front of the hub to the inner surface of the shroud, wherein the external blades protrude from the outer surface of the shroud and extend along the outer surface.

Aspect 13. The heat transfer circuit of aspect 12, wherein the housing includes an interior surface facing the outer surface of the shroud, the external blades protruding from the outer surface of the shroud into a space between the interior surface of the housing and the outer surface of the shroud.

Aspect 14. The heat transfer circuit of either one of aspects 12 or 13, wherein the shroud is located between the impeller blades and the external blades.

Aspect 15. The heat transfer circuit of any one of aspects 9-14, wherein the external blades protrude from the rear surface of the hub and extend along the rear surface.

Aspect 16. The heat transfer circuit of aspect 15, wherein the housing includes an interior surface that faces the rear surface of the impeller, the external blades disposed in a space between the interior space of the housing and the rear surface of the impeller.

Aspect 17. A method of providing sealing between an impeller and a housing in a compressor, the method comprising:

positioning external blades of the impeller in a passage between the housing of the compressor and one of a rear surface of the impeller or an outer surface of a shroud of the impeller, the impeller including impeller blades; and rotating the impeller relative to the housing, rotating the impeller relative to the housing including:

rotating the impeller blades relative to the housing to compress a working fluid, a portion of the compressed working fluid flowing into the passage, and rotating the external blades relative to the housing to increase a pressure within the passage.

The examples disclosed in this application are to be considered in all respects as illustrative and not limitative. The scope of the invention is indicated by the appended claims rather than by the foregoing description; and all changes which come within the meaning and range of equivalency of the claims are intended to be embraced therein.

What is claimed is:

1. A compressor, comprising:

a housing;

a shaft with an end; and an impeller rotatable relative to the housing by the shaft, the impeller including:

a hub attached to the end of the shaft, impeller blades extending from a front of the hub, a shroud including an outer surface and an inner surface opposite to the outer surface, at least one of the impeller blades extending from the front of the hub to the inner surface of the shroud, and external blades protruding from the outer surface of the shroud of the impeller, the external blades curving in a circumferential direction of the impeller along the outer surface of the shroud of the impeller, at least one of the external blades extending less than entirely across the outer surface of the shroud of the impeller, and the external blades being aligned in the circumferential direction.

2. The compressor of claim 1, wherein the external blades are a first set of the external blades, and the compressor further comprising:

a second set of external blades protruding from the outer surface of the shroud of the impeller, the first set of the external blades spaced apart from the second set of the external blades in an axial direction.

3. The compressor of claim 1, wherein the housing includes an interior surface with a notch, the interior surface facing the outer surface of the shroud, the external blades protruding into the notch.

4. The compressor of claim 1, wherein the housing includes an interior surface facing the outer surface of the shroud, the external blades protruding from the outer surface of the shroud into a space between the interior surface of the housing and the outer surface of the shroud.

5. The compressor of claim 1, wherein the shroud is located between the impeller blades and the external blades.

6. The compressor of claim 1, wherein the impeller includes a second set of external blades that protrude from a rear surface of the hub of the impeller and extend along the rear surface.

7. The compressor of claim 6, wherein the housing includes an interior surface that faces the rear surface of the impeller, the second set of external blades disposed in a space between the interior space of the housing and the rear surface of the impeller.

8. A heat transfer circuit, comprising:

a compressor including:

a housing;

a shaft with an end; and an impeller rotatable relative to the housing by the shaft to compress a working fluid, the impeller including:

a hub attached to the end of the shaft, impeller blades extending from a front of the hub, a shroud including an outer surface and an inner surface opposite to the outer surface, at least one of the impeller blades extending from the front of the hub to the inner surface of the shroud, and external blades protruding from the outer surface of the shroud of the impeller, the external blades curving in a circumferential direction of the impeller along the outer surface of the shroud of the impeller, at least one of the external blades extending less than entirely across the outer surface of the shroud of the impeller, and the external blades being aligned in the circumferential direction;

a condenser to cool the working fluid compressed by the compressor;

an expander to expand the working fluid cooled by the condenser; and an evaporator to heat the working fluid expanded by the expander with a process fluid.

9. The heat transfer circuit of claim 8, wherein the external blades are a first set of external blades, and the compressor further comprising:

a second set of external blades protruding from the outer surface of the shroud of the impeller, the first set of external blades spaced apart from the second set of external blades in an axial direction.

10. The heat transfer circuit of claim 8, wherein the housing includes an interior surface with a notch, the interior surface facing the outer surface of the shroud, the external blades protruding into the notch.

11. The heat transfer circuit of claim 8, wherein the housing includes an interior surface facing the outer surface of the shroud, the external blades protruding from the outer surface of the shroud into a space between the interior surface of the housing and the outer surface of the shroud.

12. The heat transfer circuit of claim 8, wherein the shroud is located between the impeller blades and the external blades.

13. The heat transfer circuit of claim 8, wherein the impeller includes a second set of external blades that protrude from a rear surface of the hub of the impeller and extend along the rear surface.

14. The heat transfer circuit of claim 13, wherein the housing includes an interior surface that faces the rear surface of the impeller, the second set of external blades disposed in a space between the interior space of the housing and the rear surface of the impeller.

15. A method of providing sealing between an impeller and a housing in a compressor, the method comprising:

positioning external blades of the impeller in a passage between the housing of the compressor and an outer surface of a shroud of the impeller, the external blades curving in a circumferential direction of the impeller along the outer surface of the shroud of the impeller, at least one of the external blades extending less than entirely across the outer surface of the shroud of the impeller, the external blades being aligned in the circumferential direction, the impeller including impeller blades, and at least one of the impeller blades extending from a front of the hub to the inner surface of the shroud; and rotating the impeller relative to the housing, rotating the impeller relative to the housing including:

rotating the impeller blades relative to the housing to compress a working fluid, a portion of the compressed working fluid flowing into the passage, and rotating the external blades relative to the housing to increase a pressure within the passage.

16. The compressor of claim 1, wherein the external blades extend to have a concave or convex shape along the outer surface of the shroud of the impeller.

17. The heat transfer circuit of claim 8, wherein the external blades extend to have a concave or convex shape along the outer surface of the shroud of the impeller.

18. The method of claim 15, wherein the external blades extend to have a concave or convex shape along the outer surface of the shroud of the impeller.

* * * * *